US005640082A

United States Patent [19]

Lusher et al.

[11] Patent Number: 5,640,082

[45] Date of Patent: Jun. 17, 1997

[54] DUTY CYCLE CONTROLLED SWITCH VARIABLE CAPACITOR CIRCUIT

[75] Inventors: David M. Lusher, Gardena; C. Russ Gulick, El Segundo, both of Calif.

[73] Assignee: Hughes Electronics, Los Angeles, Calif.

[21] Appl. No.: 594,738

[22] Filed: Jan. 31, 1996

[51] Int. Cl.[6] ..... G05F 1/12

[52] U.S. Cl. ..... 323/293; 323/352; 323/364

[58] Field of Search ..... 323/265, 282, 323/293, 349, 351, 352, 364

[56] References Cited

U.S. PATENT DOCUMENTS

| | | | |
|---|---|---|---|
| 3,621,377 | 11/1971 | Lim | 323/352 |
| 3,702,405 | 11/1972 | Zwirn et al. | 323/352 |
| 5,399,955 | 3/1995 | Glaser et al. | 323/208 |

OTHER PUBLICATIONS

"Controlled Resonant Converters with Switching Frequency Fixed", Harada et al., IEEE Power Electronics Specialists Conference (PESC), Dec. 1987, pp. 431–438, IEEE Catalog No. 87CH2459–6.

*Primary Examiner*—Jeffrey L. Sterrett

*Attorney, Agent, or Firm*—Leonard A. Alkov; Wanda K. Denson-Low

[57] ABSTRACT

A switch controlled variable capacitor circuit that includes a capacitor having a first terminal and a second terminal; a switch connected across the first and second terminals of the capacitor; a pulse width modulator for controlling the switch to close at positive going zero crossings of a sinusoidally varying current provided to the first and second terminals, and to open at D seconds after the positive going zero crossings, wherein D is in a range of 0.25 to 0.5 times the period T of the sinusoidally varying current; and a diode connected across the first and second terminal of the capacitor for conducting the sinusoidally varying current during a portion of a negative half of each period of the sinusoidally varying current. The switch variable capacitor circuit has a capacitance that is controlled by varying D.

2 Claims, 2 Drawing Sheets

DUTY CYCLE CONTROLLED SWITCH VARIABLE CAPACITOR CIRCUIT

BACKGROUND OF THE INVENTION

The disclosed invention is directed generally to a variable capacitance structure, and more particularly to a pulse width modulated switch variable capacitance structure.

Switch variable capacitor circuits have been utilized in resonant power supplies for regulation of the output voltage. A known switch variable capacitor circuit is disclosed in "Controlled Resonant Converters with Switching Frequency Fixed", Harada et al., IEEE Power Electronics Specialists Conference (PESC), 1987, pages 431–438, IEEE Catalog No. 87CH2459-6. The switch variable capacitor circuit of Harada et al. employs a variable phase drive signal to create a proportional change in effective capacitance, and includes a synchronizer, an error amplifier, a driver, and phase shifter circuits. A consideration with such circuit is that at switching frequencies above 1 MHz, phase shifter circuits are large and costly, and cannot be conveniently implemented with a single existing integrated circuit.

SUMMARY OF THE INVENTION

It would therefore be an advantage to provide a switch variable capacitor circuit that does not require a variable phase drive.

Another advantage would be to provide a switch variable capacitor circuit that does not require phase shifters.

The foregoing and other advantages are provided by the invention in a switch variable capacitor that includes a capacitor having a first terminal and a second terminal; a switch connected across the first and second terminals of the capacitor; a pulse width modulator for controlling the switch to close at positive going zero crossing of a sinusoidally varying current applied to the first and second terminals, and to open D seconds after the positive going zero crossings, wherein D is in a range of 0.25 to 0.5 times the period T of the sinusoidally varying current; and a diode connected across the first and second terminal of the capacitor for conducting the sinusoidally varying current during a portion of a negative half of each period of the sinusoidally varying current. The switch variable capacitor circuit has a capacitance that is controlled by the value of D.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
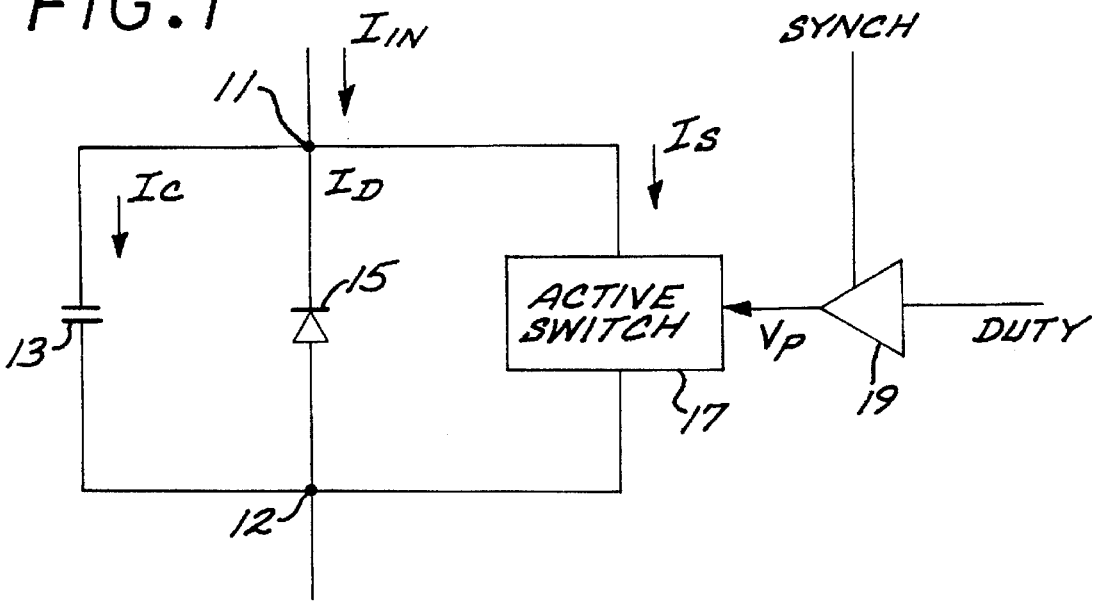
FIG. 1 sets forth a schematic diagram of a switch variable capacitor circuit in accordance with the invention.

In the following detailed description and in the several figures of the drawing, like elements are identified with like reference numerals.

Referring now to FIG. 1, set forth therein is a schematic diagram of a switch variable capacitor circuit in accordance with the invention which includes a capacitor 13 having a first terminal connected to a first node 11 and a second terminal connected to a second node 12. A diode 15 has its anode connected to the second node 12 and its cathode connected to the first node 11. An active switch 17 is connected between the first node 11 and the second node 11. When the active switch 17 is on, it is closed and provides an electrically conductive path between the first node 11 and the second node 12. When the active switch is off, it is open and forms an open circuit between the first node 11 and the second node 12. The active switch 17 is controlled by a periodic pulse train Vp provided by a pulse width modulator 19 which receives a SYNCH control signal for synchronizing its operation to a reference frequency and a DUTY signal for controlling its duty factor. The capacitor 13, the diode 15 and the active switch 17 are thus connected in parallel.

In operation, a sinusoidal input current IiN is applied to the first node 11 and the second node 12, and in accordance with the invention the pulse width modulator 19 controls the active switch 17 with a pulse train $V_p$ that is synchronized with the frequency of the sinusoidal input current $I_{IN}$ and has a duty factor that is controlled to achieve a desired capacitance across the first node and the second node. Pursuant to the switching of the active switch 17 under the control of the pulse width modulator 19, the input current $I_{IN}$ is commutated between the active switch 17, the capacitor 13, and the diode 15.

Figure 2:
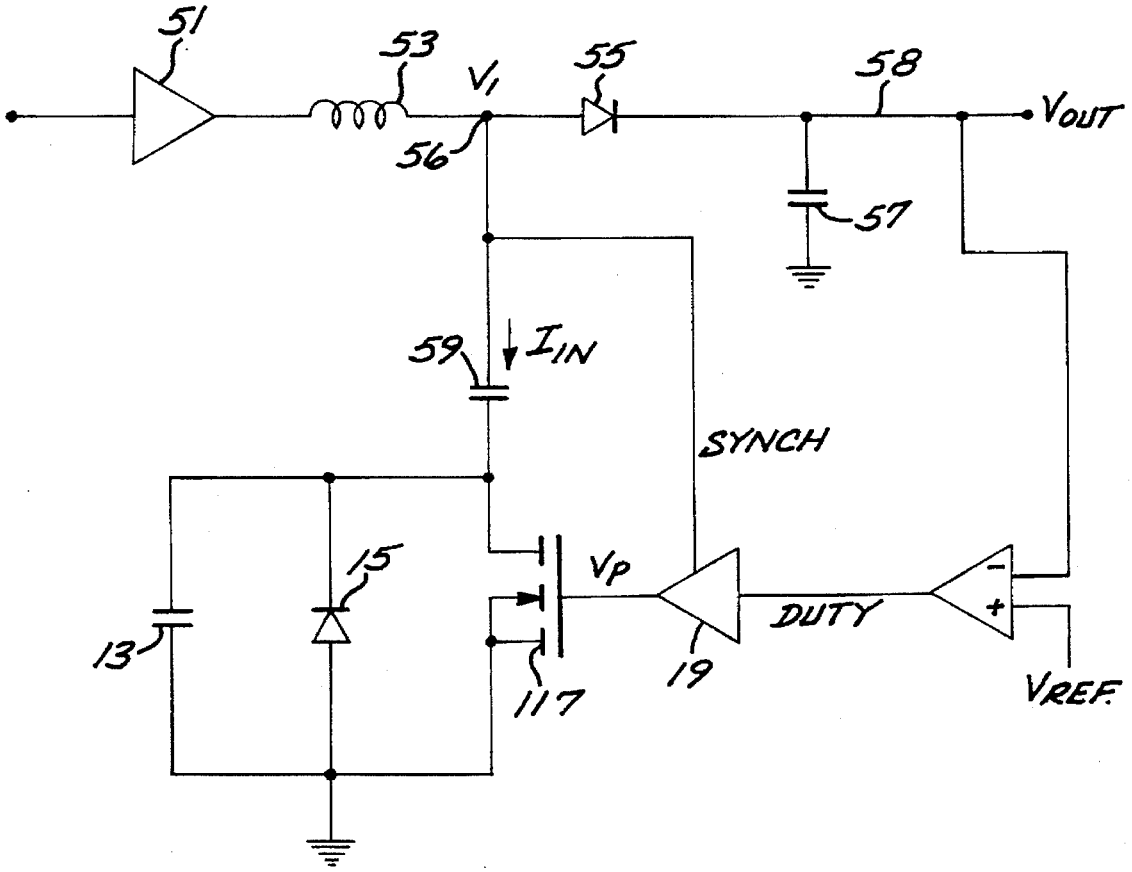
FIG. 2 schematically sets forth waveforms of signals of the switch variable capacitor of FIG. 1.

Referring now to FIG. 2, set forth therein are wave-forms of the pertinent signals of the circuit of FIG. 1. The input current $I_{IN}$ comprises a sinusoidal current having a period of T seconds. The pulse width modulator drive signal $V_p$ provided to the active switch 17 comprises a voltage pulse waveform that is synchronized to the sinusoidal input current $I_{IN}$ and has a period T. The rising edges of the $V_p$ pulses are synchronized with the negative to positive zero crossings of the sinusoidal input current $I_{IN}$, and the $V_t$ pulses have a pulse width D, wherein D is between 0.25 T and 0.5 T. Thus, the falling edge of each $V_p$ pulse occurs between a positive peak and the following positive to negative zero crossing of the sinusoidal input current $I_{IN}$. The width D of the pulses is controlled to achieve a desired average capacitance.

The active switch thus conducts the input current during each pulse of the drive signal $V_p$, and the current $I_s$ through the active switch comprises the input current that flows between 0 seconds and D seconds of each period T. There is no current through the capacitor 13 during each pulse of the drive signal PWM. After a pulse of the drive signal $V_p$ ends, the capacitor 13 is charged and then discharged by the sinusoidal input current. Since amount of charge that must be discharged from the capacitor is the same as the amount of charge that flows between the end of the $V_p$ pulse and the center of the period T, and since the second half of a sine wave is inversely symmetrical with respect to the first half of a sine wave, the voltage $V_c$across the capacitor comprises a top portion of a positive half cycle of a sine wave that is centered about T/2. The capacitor voltage $V_c$ starts increasing from approximately zero at D seconds after the start of the period T, peaks at T/2 seconds after the start of the period T and decreases to one-diode drop below zero at (T-D) seconds after the start of the period T.

While the capacitor voltage $V_c$ is positive, the sinusoidal input current flows through the capacitor 13, and the current $I_c$ through the capacitor 13 comprises the sinusoidal input current that flows between D seconds and (T-D) seconds of each period T. While the capacitor voltage is one diode drop below zero and the input current is negative, the input current flows through the diode 15 and the current $I_d$ through the diode 15 comprises the sinusoidal input current that flows between (T-D) seconds and T seconds of each period T.

Thus, the sinusoidal input current $I_{IN}$ is commutated as follows during each period of T seconds. Between 0 seconds and D seconds, the current flows through the active switch 17. Between D seconds and (T-D) seconds, the current flows through the capacitor 13. Between (T-D) seconds and T seconds, the current flows through the diode 15.

The duty factor of the drive signal $V_p$, which is the ratio between the pulse duration D and the period T, is controlled to control the effective capacitance provided between the first node 11 and the second node 12 by the capacitor circuit of FIG. 1. In particular, the effective capacitance between the first node 11 and the second node 12 is calculated as follows relative to the pulse width D of the $V_p$ pulses. The current $I_{IN}$ is sinusoidal and thus can be expressed as:

$$I_{IN}=I_{pk}\sin\omega t$$

The average value $I_{av}$ of the sinusoidal input current $I_{IN}$ is therefore:

$$I_{av}=\frac{2I_{pk}}{T}\int_0^{2\pi}\sin\omega t dt=\frac{2I_{pk}}{\pi}$$

The voltage across the capacitor is:

$$V_c=\frac{I_{pk}}{C}\int_D^{T-D}-\cos\omega t dt$$

The average voltage $V_{av}$ across the capacitor is:

$$V_{av}=\frac{I_{pk}T}{2\pi^2C}\left[1+\sin\left(\frac{\pi}{2}-\frac{2\pi D}{T}\right)\right]$$

The average capacitance $C_{avsi}$ equal to the average current divided by the product of the average voltage times the frequency in radians of the sinusoidal input current $I_{IN}$:

$$C_{av}=\frac{TI_{av}}{2\pi V_{av}}=\frac{4\pi C}{\left[1+\sin\left(\frac{\pi}{2}-\frac{2\pi D}{T}\right)\right]}$$

Thus, the capacitance of the variable capacitor of FIG. 9 is controlled by controlling the pulse width D of the $V_p$ pulses.

Figure 3:
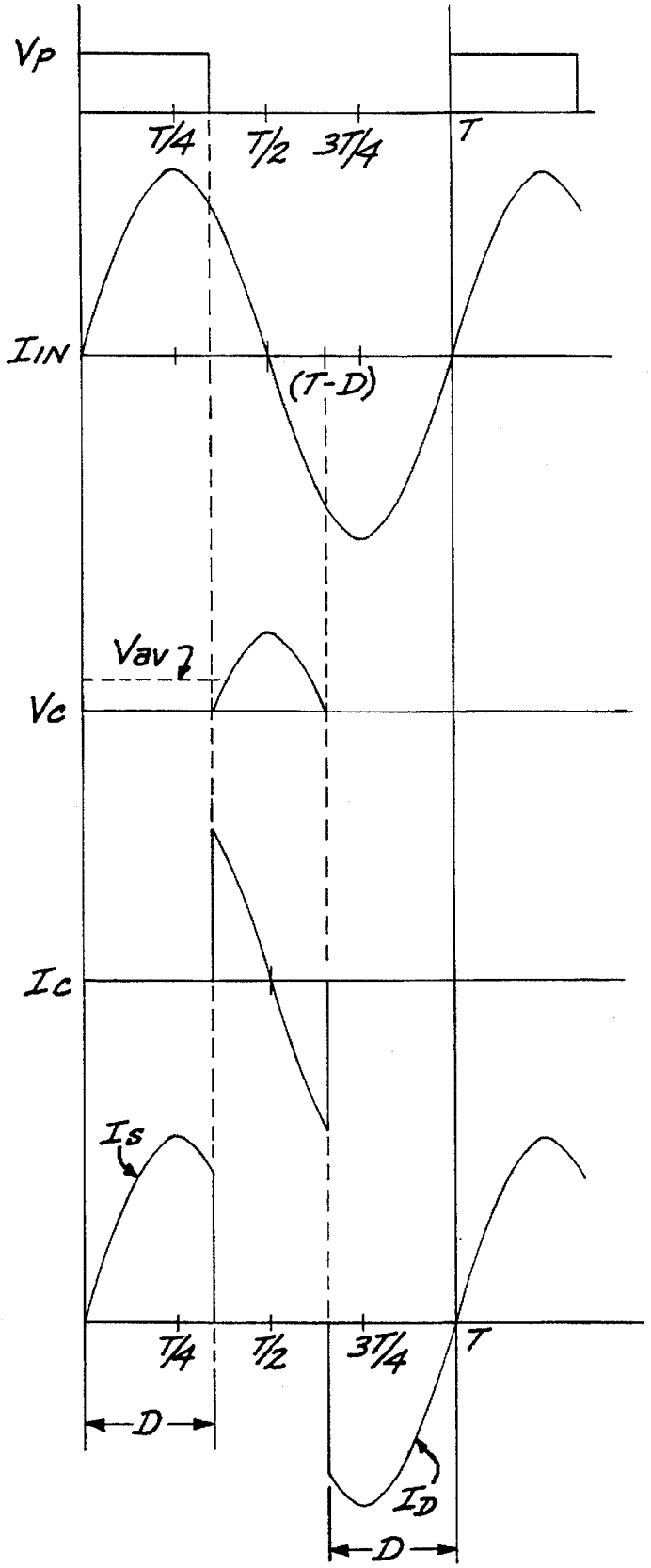
FIG. 3 sets forth a schematic diagram of a DC to DC converter that utilizes the switch variable capacitor of FIG. 1.

Referring now to FIG. 3, set forth therein is a schematic diagram of a DC to DC converter that advantageously utilizes a switch variable capacitor circuit in accordance with the invention. The DC to DC converter includes a resonant inverter 51 which is responsive to a DC input and provides an AC output on an output that is connected to one terminal of an inductor 53. The other terminal of the inductor 53 is connected to the anode of a diode 55 at a node 56. One terminal of a filter capacitor 57 is connected to ground and the other terminal of the capacitor 57 is connected to the cathode of the diode 55 at a node 58. The DC output $V_{OUT}$ of the DC to DC converter of FIG. 3 is provided at the node 58 formed by the connection of the capacitor 57 and the cathode of the diode 55. A capacitor 59 is connected between the node 56 and a switch variable capacitor 60 in accordance with the invention.

The switch variable capacitor 60 comprises a particular implementation of the switch variable capacitor of FIG. 1 wherein the active switch is implemented by an n-channel transistor 117. The synchronizing signal SYNCH for the pulse width modulator controller 17 is provided by the voltage $V_1$ at the node 54, and the DUTY signal for controlling the pulse width modulator 17 is provided by the output of an error amplifier 61 having an inverting input connected to the node 58 formed by the connection of the diode 55 and the capacitor 57. The non-inverting input of the error amplifier 61 is connected to a reference voltage $V_{REF}$.

In the resonant inverter of FIG. 3, the synchronizing signal SYNCH for the pulse width modulator 17 is derived from the voltage $V_1$ which is a sinusoidally varying voltage having a fixed phase relation to the current $I_{IN}$ flowing through the switch variable capacitor 60. The pulse width modulator 19 is therefore phased such that the drive signal $V_p$ is synchronized with the current $I_{IN}$ as described above relative to FIG. 2.

Thus, the foregoing has been a disclosure of a variable capacitor circuit that does not utilize a variable phase drive and does not require phase shifters, and is readily implemented with off-the-shelf low power components. As a result, a variable capacitor circuit in accordance with the invention provides for superior cost, weight, volume, performance and efficiency capabilities.

Although the foregoing has been a description and illustration of specific embodiments of the invention, various modifications and changes thereto can be made by persons skilled in the art without departing from the scope and spirit of the invention as defined by the following claims.

What is claimed is:

1. A switch controlled variable capacitor circuit which is connected to a source of sinusoidally varying current having a frequency and a period T wherein the current flows in a first direction during a first half of each period and in a second direction during a second half of each period, said sinusoidally varying current having a positive going zero crossing at the start of each period and a negative going zero crossing at the middle of each period, the switch controlled variable capacitor circuit comprising:

a capacitor having a first terminal and a second terminal;

switching means connected across said first and second terminals;

pulse width modulation means for controlling said switching means to close at positive going zero crossings of the sinusoidally varying current and to open at D seconds after said positive going zero crossings, wherein D is in a range of 0.25 T to 0.5 T, such that said switching means conducts the sinusoidally varying current while said switching means is closed; and a diode connected across said first terminal of said capacitor and said second terminal of said capacitor for conducting said sinusoidally varying current when said sinusoidally varying current is flowing in the second direction;

whereby the switch variable capacitor circuit has a capacitance that is controlled by the value of said D seconds.

2. The switch controlled variable capacitor of claim 1 wherein said pulse width modulation means provides a square wave signal to said switching means, said square wave signal having a period that is the same as the period of said sinusoidally varying current and a pulse width D, said square wave signal having a duty factor that controls the capacitance of the switch variable capacitor circuit.

* * * * *